United States Patent [19]

Cobaugh et al.

[11] 4,274,693

[45] Jun. 23, 1981

[54] SNAP ON CARD STRAIGHTENER

[75] Inventors: Robert F. Cobaugh, Elizabethtown; David W. Mendenhall, Hershey, both of Pa.

[73] Assignee: AMP Incorporated, Harrisburg, Pa.

[21] Appl. No.: 100,668

[22] Filed: Dec. 5, 1979

[51] Int. Cl.[3] ..... H01R 13/62

[52] U.S. Cl. ..... 339/65

[58] Field of Search ..... 339/65, 66, 176 MP, 339/186

[56] References Cited

U.S. PATENT DOCUMENTS

| | | | |
|---|---|---|---|
| 3,768,066 | 10/1973 | Mattingly, Jr. et al. | 339/65 |
| 3,801,953 | 4/1974 | Lynch | 339/65 |
| 4,109,300 | 8/1978 | Reimer | 361/415 |
| 4,204,737 | 5/1980 | Faber et al. | 339/65 |

FOREIGN PATENT DOCUMENTS

| | | | |
|---|---|---|---|
| 2613704 | 10/1977 | Fed. Rep. of Germany | 339/186 M |

*Primary Examiner*—Joseph H. McGlynn

*Attorney, Agent, or Firm*—Gerald K. Kita; Jay L. Seitchik

[57] ABSTRACT

A unitary, molded card straightener is selectively mounted along the mouth of a card edge connector. The straightener funnels the card edge toward the mouth of the card edge connector and impinges against the side of the card prior to entry thereof into the connector, so that warpage in the card is flattened by the straightener.

8 Claims, 6 Drawing Figures

SNAP ON CARD STRAIGHTENER

FIELD OF THE INVENTION

The present invention relates to an electrical connector of the type which contains rows of resilient blade contacts for electrically engaging the circuit paths of a circuit card, the edge of which is pluggably inserted into the connector. The invention further relates to a device for straightening any warpage of a card edge as the same is being inserted into the connector.

BACKGROUND OF THE INVENTION

A card edge connector includes a molded dielectric housing having a top opening cavity into which an edge of a circuit card is inserted. The housing is provided with rows of electrical contacts on either side of the cavity. The contacts are in the form of resilient leaf springs which frictionally engage circuit paths extending to the edges of the card establishing electrical connections into and out from the circuit card.

If the card edge is warped, considerable friction is required to insert the card into the housing cavity, which is designed for a planar unwarped card.

SUMMARY OF THE INVENTION

The present invention relates to an improvement in card edge connectors. An auxiliary card guide and straightener is assembled onto the connector to provide a card guide and straightener at the mouth of the card receiving cavity of the connector. The device is of unitary molded plastic construction and provides a sloped top wall for funneling a warped card edge toward the connector cavity. The top wall impinges against the card edge, flattening warpage in the same, sufficiently for the card to enter into the connector cavity.

The card guide and straightener of the present invention includes a pair of jaws which frictionally grasp either side of a partition wall separating adjacent contacts of the connector. Additionally, the jaws are molded with inverted hook portions which hook onto an external side wall of the connector housing. Projecting teeth are molded on the jaws to assist in gripping a partition wall. The top wall is bifurcated by a slotted opening in alignment with the clearance between the jaws which enables molding the jaw teeth and hook configurations by straight action molding dies, one of which passes through the slotted opening to cooperate with the second die and mold the teeth integral with the jaws.

The card guide and straightener can be mounted individually or in opposed pairs along the mouth of the card edge connector. The straighteners reduce the friction required to straighten the card edge as compared with straightening by use of the mouth of the connector.

OBJECTS

It is an object of the present invention to provide a card guide and straightener for mounting on a card edge connector.

Another object of the present invention is to provide a unitary molded card edge straightener which is frictionally assembled to a card edge connector over the mouth of a cavity of the connector into which a card edge is inserted.

Another object of the present invention is to provide a card guide and straightener which is located along the mouth of a card receiving cavity of a card edge connector to straighten any warpage of a card edge sufficiently to allow the card to enter the cavity.

Another object of the present invention is to provide a unitary, molded card edge funnel and straightener having jaws which resiliently grasp onto a card edge connector and which hook over an external wall of the connector, so that the straightener will frictionally engage a card edge and flatten any warpage thereof, with less friction than normally encountered by insertion of a warped card into the mouth of the card receiving cavity of the connector.

Other objects and many advantages of the present invention will become apparent from the following detailed description taken in conjunction with the drawings.

DRAWINGS

DETAILED DESCRIPTION

Figure 1:
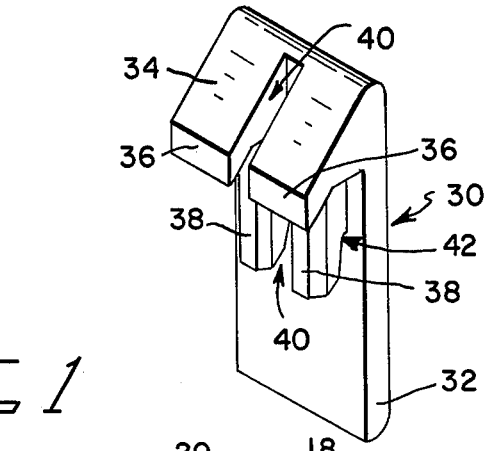
FIG. 1 is an enlarged fragmentary perspective of a card edge connector together with a plurality of card guiding and straightening devices.
Figure 3:
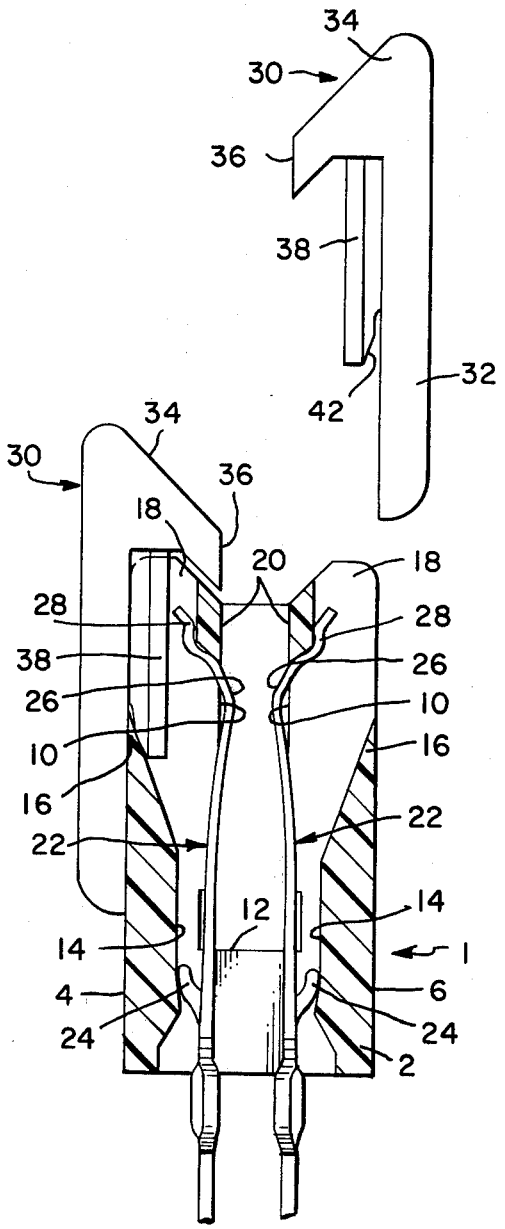
FIG. 3 is an enlarged end elevation in section of the connector shown in FIG. 1, illustrating electrical contacts and a pair of card guiding and straightening devices, one of which is illustrated in exploded configuration.
Figure 4:
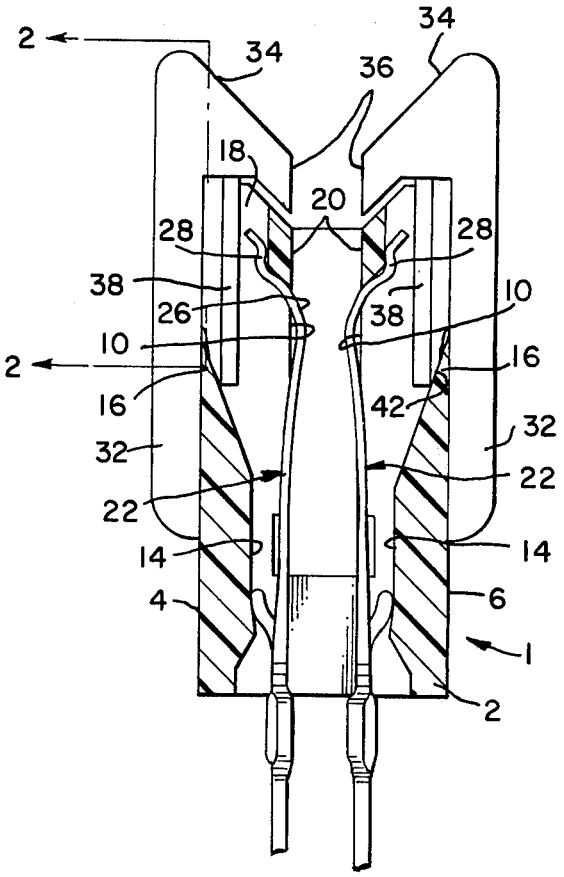
FIG. 4 is a view similar to FIG. 3 with both devices assembled to the connector.

With more particular reference to FIGS. 1, 3 and 4 of the drawings, a card edge connector is illustrated generally at 1 as comprising an elongated unitary housing 2 molded of rigid dielectric material and having elongated side walls 4 and 6 and end walls, one of which is shown at 8. The housing is provided with a vertically recessed, elongated cavity 10, open along its top and adapted to pluggably receive a card edge therein. A card edge is fully inserted when registered against a bottom wall 12 of the cavity. Horizontally along each side of the card receiving cavity 10 a row of vertically elongated channels 14 are provided. The channels 14 intersect corresponding side walls 4 and 6, defining horizontal lips 16. Vertical partition walls 18 molded integral with the housing 2, separate adjacent channels 14 from each other. Horizontal webs 20 bridge across corresponding channels 14 and are integrally connected with corresponding partitions 18. The webs 20 are horizontally aligned along opposite sides of the cavity 10 and define a top opening entrance or mouth for the cavity 10. An elongated electrical terminal or contact 22 is vertically disposed within each channel 14. Each contact is stamped and formed from resilient spring metal into a conductive leaf spring. A lance 24 is bent out of the plane of each contact 22 to frictionally wedge in the channel, along a portion which extends alongside a side wall 4 or 6 and through the bottom wall 12. As shown in FIGS. 3 and 4, the channels 14 communicate with the card edge receiving cavity 10. Sections 26 of the contacts 22 project into the cavity 10 to frictionally engage opposite sides of a card edge when the same is inserted into the cavity. Free ends 28 of the contacts 22 engage corresponding webs 20. The webs thereby divert the free ends 28 outwardly away from the mouth of the cavity 10 and into the channels 14.

In the normal operation, the planar edge of a circuit card is inserted along the card edge receiving cavity 10 and is frictionally engaged on either side by the contact sections 26 so that electrical connections are made to the circuits of the card in the well known manner. If, however, the card is warped, considerable friction is required to insert the warped edge through the mouth of the connector cavity 10. The webs 20 defining the cavity mouth heretofore were relied upon to flatten or straighten the warped card edge.

The present invention relates to a device for realigning the warped profile of a card edge before insertion into the connector cavity, an amount sufficient for the card to pass through the mouth of the cavity. It is not intended that the card be permanently straightened or flattened absolutely to a flat configuration.

As shown more particularly in FIGS. 1 and 3 a card guide and straightener is illustrated generally at 30 and is of one piece molded plastic construction. The device 30 includes a vertical first leg 32 connected at its top with a second leg 34 having a diagonally inclined top wall terminating in a vertical end wall 36. The top wall 34 overlies a pair of vertically elongated jaws 38 which are integrally connected to the leg 32 and separated by a vertical clearance 40 of restricted horizontal width. Each jaw 38 is provided at the lower most end thereof with an undercut, tapered recess 42 providing a hook configuration. The jaws 38 are separated by the vertical clearance 40 which also bifurcates the top wall 34.

Figure 2:
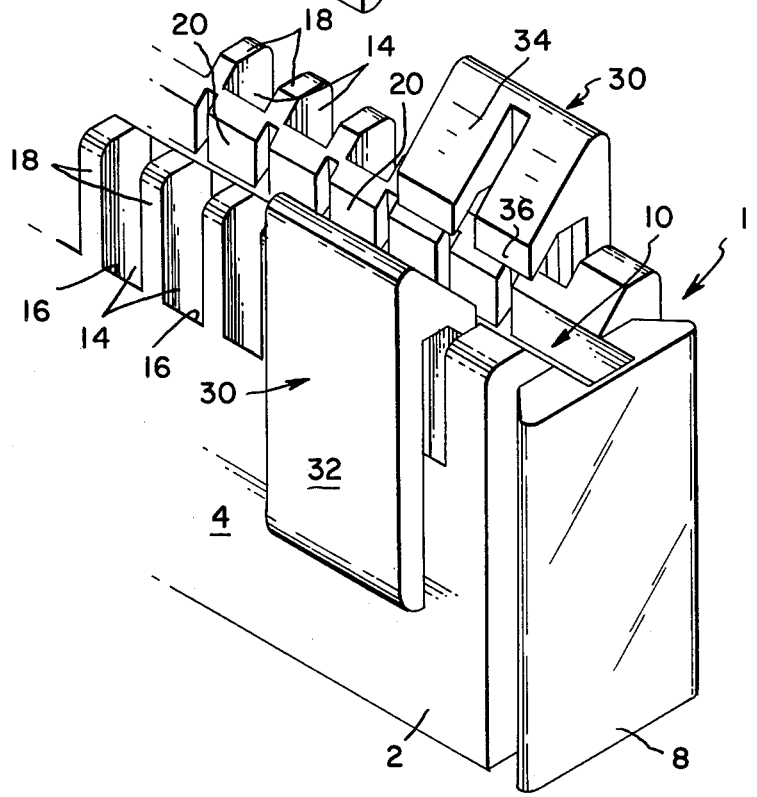
FIG. 2 is a section taken along the line 2—2 of FIG. 4.
Figure 2:
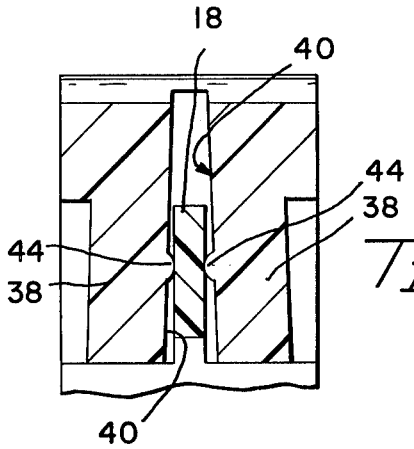

FIG. 2 illustrates the jaws 38 being provided with integral blunt teeth or projections 44 which project into opposite sides of the clearance 40. The birfurcated top wall 34 permits molding of the device 30 by a single pair of cooperating dies. A first molding die forms the leg 32 and the jaws 38 and a portion of the clearance 40 between the jaws. A second molding die cooperates with the first molding die to mold the bifurcated wall 34. A portion of the second die passes through the clearance 40 in the top wall 34 and cooperates with the first die to mold the teeth 44. At the completion of the molding operation, the two dies are separated linearly apart from each other.

In use of the device 30, reference is made to FIGS. 3 and 4. The first leg 32 will vertically impinge against a side wall 4 or 6 of the housing 2. The jaws 38 will vertically enter corresponding channels 14 with a partition wall 18 vertically entering the clearance 40 between the jaws 38. As shown in FIG. 2, the jaws 38 grasp compressibly opposite sides of the partition wall 18 with the teeth 44 enhancing the grasping or gripping connection. Further with reference to FIGS. 3 and 4 the hook portions of the jaws 38 are received over the lips 16. As shown, the lips 16 are tapered and thereby are adapted to be wedged into the tapered undercut recesses 42 of the jaws 38. As shown, the top wall 34 slopes vertically toward the mouth of the connector cavity 10 tending to funnel or guide a card edge into the mouth. The vertical wall 36 is aligned with the periphery of the mouth as defined by the vertical surfaces of the webs 20 facing into the cavity 10. Accordingly, as a card edge is inserted vertically into the cavity 10, the card edge must pass alongside the wall 36 immediately prior to entering the mouth of the cavity 10. Any warpness in the card will become flattened by being funneled against the surface 34 and then against the wall 36 prior to entry into the cavity 10. The device 30 will tend to pivot about a fulcrum provided by the lip 16. The leg 32 provides a lever which presses against the wall 14 or 16 to resist the pivoting tendency. The top wall 34 is hooked over the top edge of the connector to resist pivoting and also deflection of the device 30. FIGS. 1 and 4 illustrate a pair of devices 30 directly opposing each other on opposite sides of the cavity 10. The opposed pair of devices 30 will simultaneously flatten opposite sides of an inserted card edge.

Any number of devices 30 may be provided, the total number being selected to correspond with the severity and location of the warpage along the card edge. The cummulative amount of friction generated by engagement of the card edge with the walls 36 of the devices 30, will be less than the friction required to insert a warped card through the mouth of the cavity 10.

Figure 5:
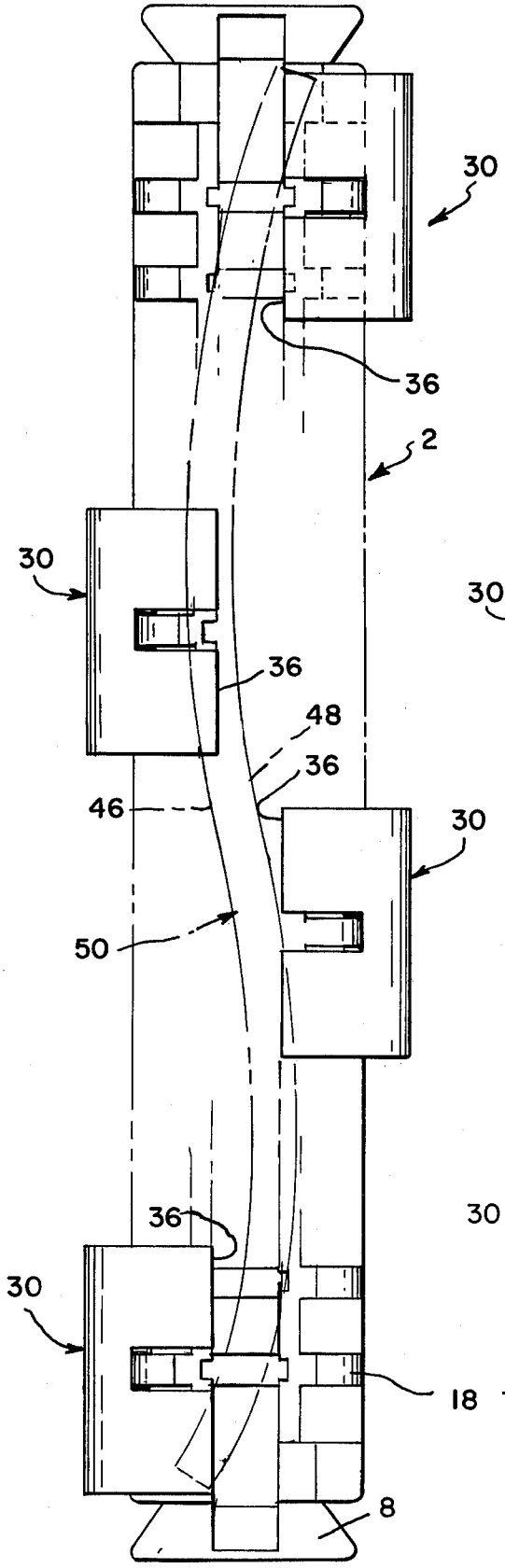
FIG. 5 is a diagramatic plan view of a card edge connector, together with a staggered array of card guiding and straightening devices and a warped card edge illustrated in phantom outline.
Figure 6:
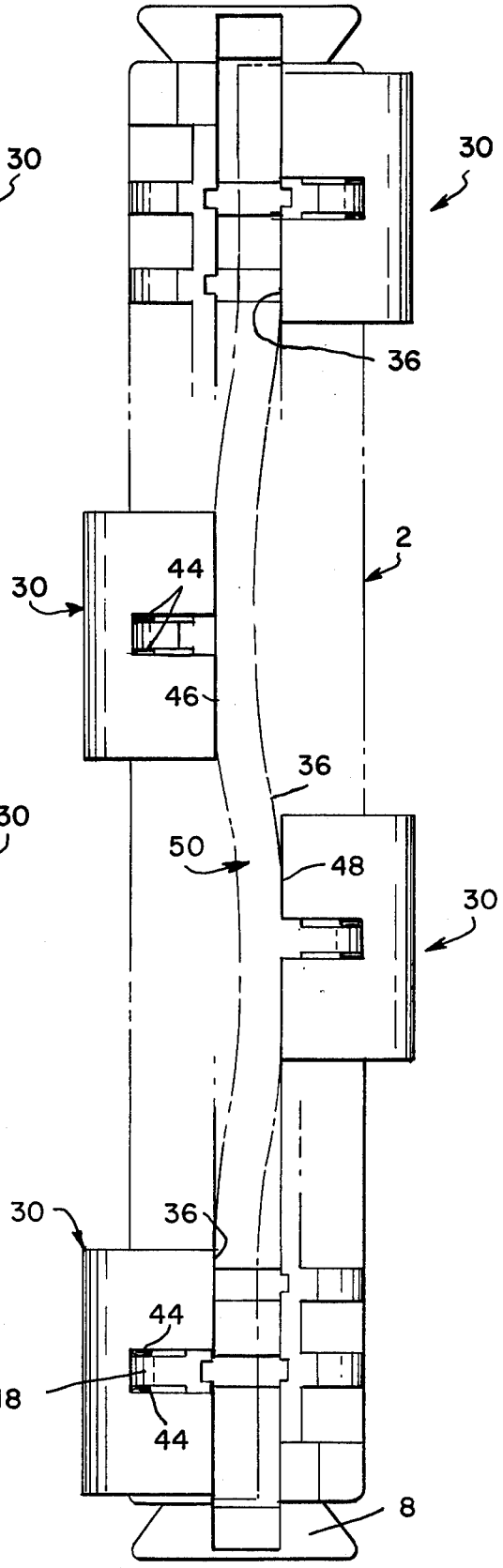
FIG. 6 is a view similar to FIG. 5 illustrating the array of card guiding and straightening devices engaging and flattening the warped card edge as shown in FIG. 5.

FIGS. 5 and 6 illustrate an alternative arrangement of the devices 30 along the connector housing 2. In FIG. 5, a card edge margin 50 is illustrated in a warped configuration, greatly exaggerated. The devices 30 along one side of the connector housing 2 are staggered with respect to the devices 30 along an opposite side of the housing. The warped surfaces 46 and 48 of the card edge 50 will be straightened when forced to pass along the surfaces 34 and 36 of the devices 30, arranged as shown in FIG. 6.

Although preferred embodiments of the present invention are disclosed, other embodiments and modifications thereof which would be apparent to one having ordinary skill in the art are intended to be covered by the spirit and scope of the claims.

What is claimed is:

1. In a card edge connector having a housing providing a vertically recessed card receiving cavity and rows of resilient electrical contacts along opposite sides of said cavity, with walls of said housing defining individual channels for containing said contacts, and with webs of said housing bridging across said channels and deflecting free ends of said contacts away from the mouth of said cavity and into said channels, the improvement comprising:

a snap on card guide having a first leg engaging the external wall of said housing and a second leg having a top wall, overlying at least one of said webs and inclined toward a mouth of said cavity, and an end wall aligned with said mouth to support a card received by said cavity, a set of jaws integral with said first leg and having a restricted width clearance therebetween wedgingly receiving a partition wall therein, each jaw having a hook portion received over said housing external wall and partially entering one of said channels.

2. The structure as recited in claim 1, and further including:

horizontal lips defined on said housing external wall where said channels project through said wall, each said hook portion being received over one said lip.

3. The structure as recited in claim 1, wherein, said jaws are molded with projections facing into said clearance between said jaws and adapted for engaging opposite sides of a partition wall received between said jaws.

4. The structure as recited in claim 3, wherein, said second leg overlies both said jaws and is bifurcated by an opening in alignment with said clearance, so that said projections on said jaws may be molded integral with said jaws.

5. A card guide adapted for snap on mounting to a card edge connector provided with a card receiving cavity and electrical contacts mounted in channels along opposite sides of said cavity, comprising:

a first leg adapted for engaging an external wall of said connector, a second leg adapted to overlie said connector and having a card supporting surface adapted to engage and support a card during insertion into said card edge connector, and a pair of jaws on said first leg adapted to enter selected ones of said channels, said jaws resiliently engaging therebetween a wall separating said selected channels, said jaws having hook portions hooked over lip sections of said wall.

6. The structure as recited in claim 5, wherein, said lip sections are defined at the intersections of said channels with said wall.

7. The structure as recited in claim 5, wherein, said jaws are molded with projections facing into a clearance between said jaws and adapted for engaging opposite sides of a partition wall separating said channels.

8. The structure as recited in claim 7, wherein, said second leg overlies both said jaws and is bifurcated by an opening in alignment with said clearance, so that said projections on said jaws may be molded integral with said jaws.

* * * * *